US012089796B2

(12) United States Patent
Singhal et al.

(10) Patent No.: US 12,089,796 B2
(45) Date of Patent: Sep. 17, 2024

(54) MOUNTING FOR A RACK ASSEMBLY OF A DISHWASHER APPLIANCE

(71) Applicant: Haier US Appliance Solutions, Inc., Wilmington, DE (US)

(72) Inventors: Arpit Singhal, Louisville, KY (US); Justin Paul Mudd, Louisville, KY (US); Jeffrey Thomas Kiesler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 96 days.

(21) Appl. No.: 17/464,934

(22) Filed: Sep. 2, 2021

(65) Prior Publication Data

US 2023/0065270 A1 Mar. 2, 2023

(51) Int. Cl.
*A47L 15/50* (2006.01)
*A47L 15/42* (2006.01)

(52) U.S. Cl.
CPC ..... *A47L 15/507* (2013.01); *A47L 15/4272* (2013.01)

(58) Field of Classification Search
None
See application file for complete search history.

(56) References Cited

U.S. PATENT DOCUMENTS

| | | | |
|---|---|---|---|
| 5,671,986 | A | 9/1997 | Vinet |
| 9,131,828 | B2 | 9/2015 | Moonkee |
| 9,579,010 | B2 | 2/2017 | Shewmaker |
| 10,022,035 | B2 | 7/2018 | Dabade |
| 10,231,598 | B2 | 3/2019 | Cho |
| 10,398,284 | B2 | 9/2019 | Hansen |
| 2019/0365197 | A1 | 12/2019 | Maddux |

FOREIGN PATENT DOCUMENTS

| | | | |
|---|---|---|---|
| EP | 1323548 | A2 | 7/2003 |
| KR | 101208156 | B1 | 12/2012 |
| KR | 20140049803 | A | 4/2014 |

*Primary Examiner* — Rita P Adhlakha
(74) *Attorney, Agent, or Firm* — Dority & Manning, P.A.

(57) ABSTRACT

A dishwasher appliance including at least one rack assembly. At least two tub mounts spaced apart from each other along the lateral direction. Each tub mount may include a base attached to the tub and at least one fixed disc connected to the base. The dishwasher further includes a pair of slide rails, one each attached to one of the opposing sides of the at least one rack assembly and in receipt of at least one of the fixed discs.

17 Claims, 14 Drawing Sheets

MOUNTING FOR A RACK ASSEMBLY OF A DISHWASHER APPLIANCE

FIELD OF THE INVENTION

The subject matter of the present disclosure relates generally to dishwasher appliances and more particularly to mounting for a rack assembly in a dishwasher appliance.

BACKGROUND OF THE INVENTION

Dishwasher appliances generally include rack assemblies for positioning various articles for cleaning within a wash chamber. One or more devices such as nozzles or spray assemblies may be included at various locations relative to the rack assemblies for purposes of delivering fluids as part of the cleaning process. During the cleaning cycle, the rack assemblies can support and position the articles while also having openings that allow fluid to pass through to the articles. Factors such as the velocity of the fluid, orientation of the fluid spray or stream relative to the articles, the shape and density of the articles in the rack assemblies, and others can impact the effectiveness of the cleaning cycle.

Devices included in dishwasher appliances may involve many parts, which adds complexity in manufacturing and servicing. Nozzles and spray assemblies may be connected by intricate piping to pumps, diverters, filtering mechanisms, and other components. Rack assemblies intended to hold articles for washing within the dishwasher may include wire and plastic baskets to hold articles and other various parts to further keep articles in place during wash cycles. In general, the reduction of the number of parts in one or more assemblies can facilitate manufacturing and service. Such reduction may also lower manufacturing costs.

As a more particular example, rack assemblies may be supported within the wash chamber by complex assemblies having multiple components. In some constructions, a rack assembly may be connected with slide rails that support the rack assembly within the wash chamber while allowing the rack assembly to move in and out of the wash chamber. Multiple parts may be required just to interconnect the rack assemblies and slide rails with each other and with the appliance while also facilitating ease of movement of the rack assembly. For example, screws, bolts, washers, wheels, and other components may be utilized.

However, such multi-part assemblies may be cumbersome to install and can add time to manufacturing and repair. An inventory of each part must typically be maintained during manufacturing, which adds an additional cost. One or more tools may be required for manufacturing and repair depending on the number and type of parts. Also, each part is potentially another component that may require servicing over the life of the appliance.

Accordingly, a rack assembly for a dishwasher appliance requiring fewer parts to support the rack assembly within the wash chamber would be desirable. Such an assembly that has the ability to be moved in and out of the dishwasher with ease while readily supporting a load of articles would also be desirable.

BRIEF DESCRIPTION OF THE INVENTION

Additional aspects and advantages of the invention will be set forth in part in the following description, or may be apparent from the description, or may be learned through practice of the invention.

In one exemplary embodiment, a dishwasher appliance is provided. The dishwasher appliance has defined vertical, lateral, and transverse directions and includes a tub defining a wash chamber for receipt of articles for washing. The dishwasher appliance may include a pair of tub mounts spaced apart from each other along the lateral direction. Each tub mount may include a base attached to the tub and a pair of fixed discs connected with the base, each disc having a disc diameter. Each fixed disc may be non-rotatable relative to the base and may form an outermost contact surface extending circumferentially around the fixed disc and may define a vertical disc diameter. The dishwasher appliance includes at least one rack assembly slidably positioned within the wash chamber and configured for the receipt of articles for washing. The at least one rack assembly may have opposing sides separated along the lateral direction. The dishwasher appliance includes a pair of slide rails, one each attached to one of the opposing sides of the at least one rack assembly. Each slide rail may define an upper track and a lower track extending along the transverse direction and may be in receipt of the pair of fixed discs. The upper track may have an arcuate profile configured for sliding receipt of an outermost contact surface of each disc. The dishwasher appliance includes at least one spray assembly positioned in the wash chamber near the at least one rack assembly. The at least one spray assembly may be configured to direct wash fluids at the at least one rack assembly.

In another exemplary embodiment, a dishwasher appliance is provided. The dishwasher appliance has defined vertical, lateral, and transverse directions and includes a tub defining a wash chamber for receipt of articles for washing. The dishwasher appliance may include at least two tub mounts spaced apart from each other along the lateral direction. Each tub mount may include a base attached to the tub and at least one fixed disc connected with the base. Each fixed disc may have a disc diameter, may be non-rotatable relative to the base and may form an outermost contact surface extending circumferentially around the fixed disc. Each fixed disc may define a vertical disc diameter. The dishwasher appliance includes at least one rack assembly slidably positioned within the wash chamber and configured for the receipt of articles for washing. The at least one rack assembly has opposing sides separated along the lateral direction. The dishwasher appliance includes a pair of slide rails, one each attached to one of the opposing sides of the at least one rack assembly. Each slide rail may define an upper track and a lower track extending along the transverse direction and may be in receipt of at least one fixed disc. The upper track may have an arcuate profile configured for sliding receipt of an outermost contact surface of the fixed disc. The dishwasher appliance includes at least one spray assembly positioned in the wash chamber near the at least one rack assembly and configured to direct wash fluids at the at least one rack assembly. For each fixed disc, the tub mount may further comprise a beam extending between the fixed disc and the base along the lateral direction and at least one rib affixed to the beam. The at least one rib may be configured to reinforce the beam.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same of similar reference numerals in the figures denotes the same or similar features unless the context indicates otherwise.

DETAILED DESCRIPTION OF THE INVENTION

Figure 1:
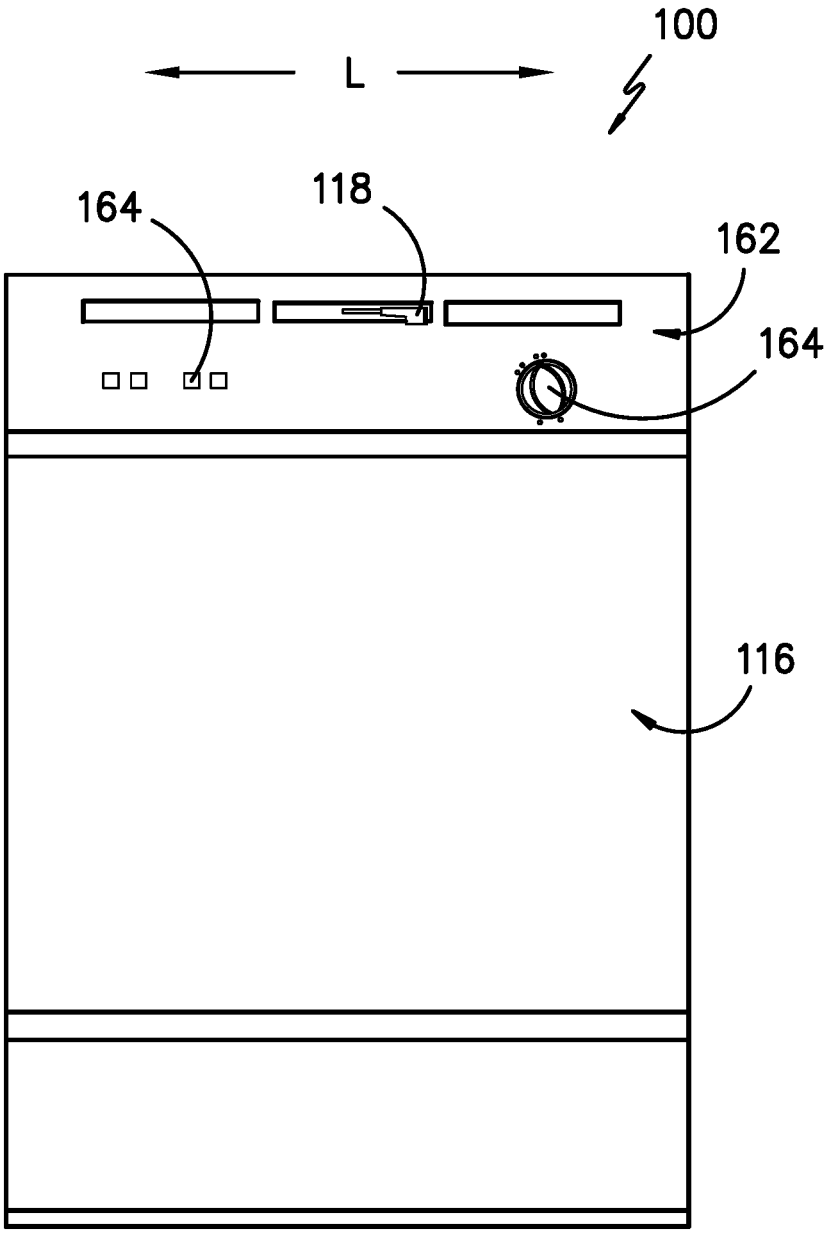
FIG. 1 provides a perspective view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
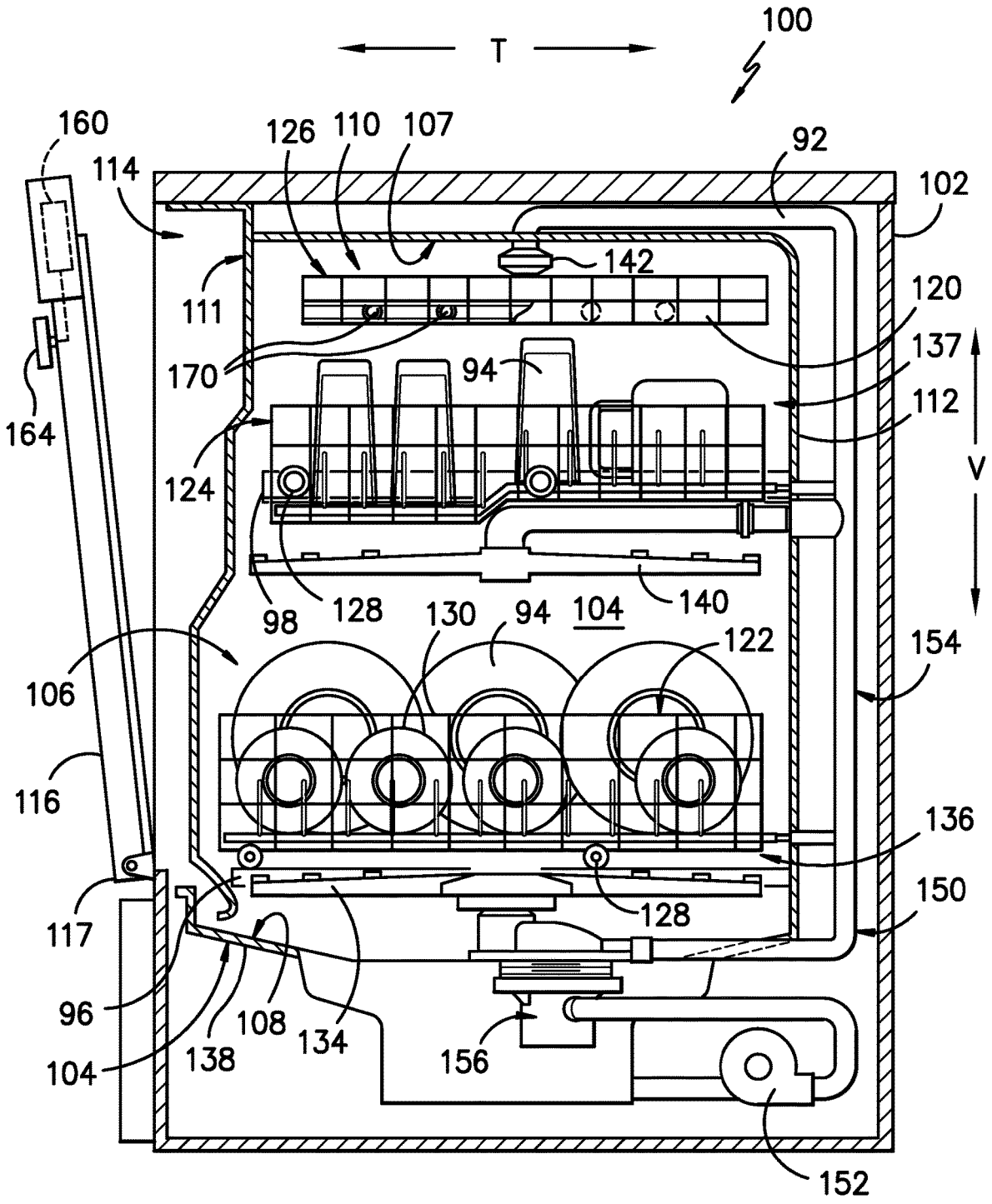
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher appliance 100 includes a cabinet 102 (FIG. 2) having a tub 104 therein that defines a wash chamber 106 for receipt of articles 94 for washing. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L, and transverse direction T are mutually perpendicular to one another.

In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

The tub 104 includes a front opening 114 and a door 116 hinged at its bottom 117 for movement between a normally closed vertical position (shown in FIG. 1), wherein the wash chamber 106 is sealed shut for washing operation, and a horizontal open position for loading and unloading of articles from the dishwasher appliance 100. According to exemplary embodiments, dishwasher appliance 100 further includes a door closure mechanism or assembly 118 that is used to lock and unlock door 116 for accessing and sealing wash chamber 106.

For this exemplary embodiment, three rack assemblies 122, 124, and 126 are provided. Rack assemblies 122, 124, 126, are configured for the receipt of articles 94 for washing. As illustrated, upper rack assembly 126 is positioned at a top portion of wash chamber 106 above middle rack assembly 124, which is positioned above lower rack assembly 122 along the vertical direction V. In other exemplary embodiments of the invention, a different number of rack assemblies may also be used.

Each may be fabricated from lattice structures including a plurality of elongated members 130 (for clarity of illustration, not all elongated members making up assemblies 122, 124 and 126 are shown in FIG. 2). Other constructions may be used as well. Each rack assembly 122, 124, and 126 is adapted for movement between an extended loading position (not shown) in which the rack is substantially positioned outside the wash chamber 106, and a retracted position (shown in FIGS. 1 and 2) in which the rack is located inside the wash chamber 106.

Figure 3:
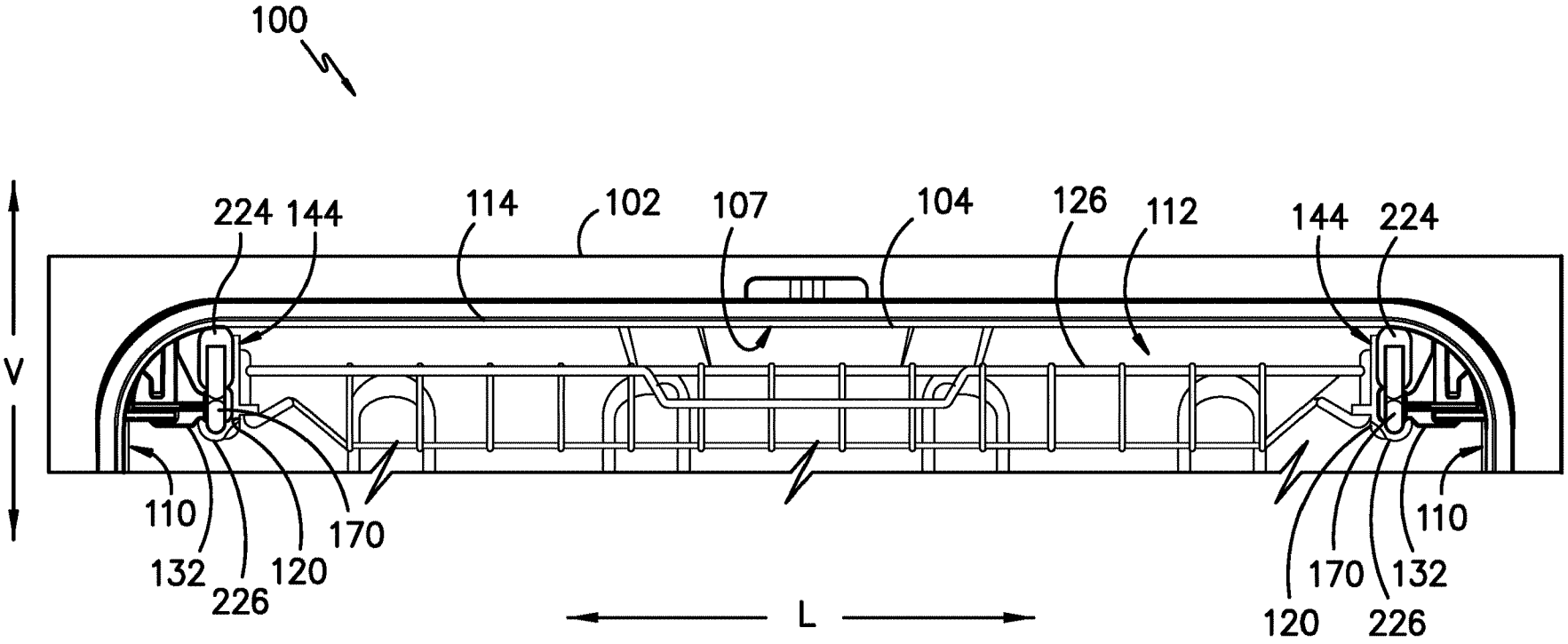
FIG. 3 provides a front view of an exemplary embodiment of a top portion of the exemplary dishwashing appliance of FIG. 1.
Figure 4:
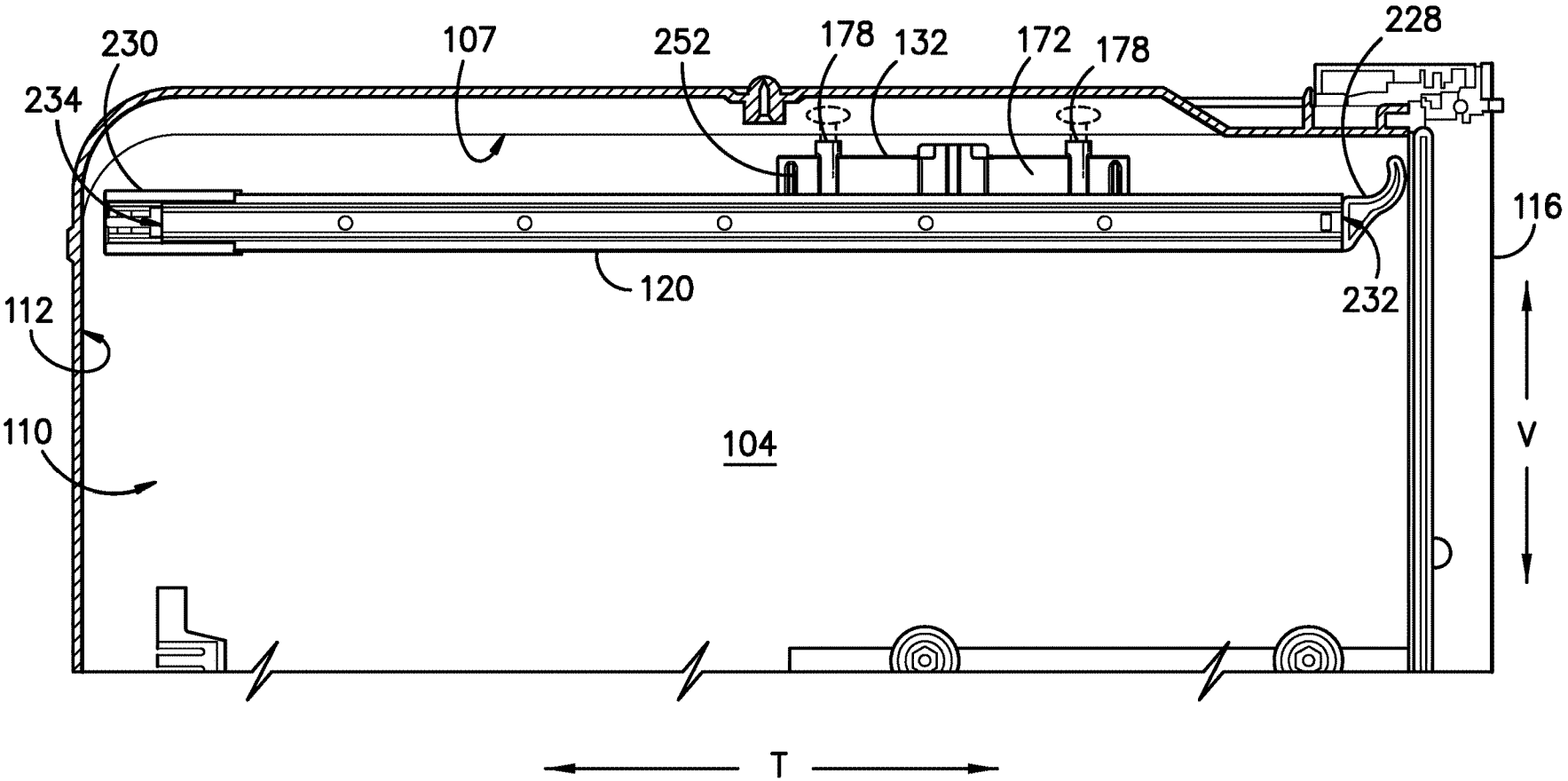
FIG. 4 provides a side view of an exemplary embodiment of a tub mount and rack assembly in a top portion of a tub of the exemplary dishwashing appliance of FIG. 1.

For rack assemblies 122 and 124, slide rails 96, 98 and rollers 128 are illustrated herein as facilitating movement of the respective rack assemblies 122, 124. However, in other exemplary embodiments, any suitable sliding mechanism or member may be used for the middle rack assembly 124 and the lower rack assembly 122. For example, slide rails 96, 98 may be mounted to side walls 110 or formed as part of side walls 110. Alternatively, one or more rack assemblies may employ embodiments of tub mounts 132 (FIG. 3) and other exemplary aspects of the present invention as further described herein. A silverware basket (not shown) may be removably attached to rack assembly 122 for placement of silverware, utensils, and the like, that are otherwise too small to be accommodated by the rack assemblies.

For this exemplary embodiment, dishwasher appliance 100 further includes a plurality of spray assemblies 134, 140, 142 for directing a flow of water or wash fluid onto the articles placed within wash chamber 106. More specifically, as illustrated in FIG. 2, dishwasher appliance 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region 137 of wash chamber 106 and is located below and in close proximity to middle rack assembly 124. In this regard, mid-level spray arm assembly 140 is configured for urging a flow of wash fluid up through middle rack assembly 124 and third rack assembly 126. Additionally, a third spray assembly 142 (also referred to as an upper spray assembly 142) is located above upper or third rack assembly 126 along the vertical direction V. In this manner, third spray assembly 142 is configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 is located within sump 138. Pump 152 may also be located within a machinery compartment located below sump 138 of tub 104, as generally recognized in the art.

Fluid circulation assembly 150 includes one or more fluid conduits or circulation piping for directing water and/or wash fluid from pump 152 to the various spray assemblies and manifolds. For example, as illustrated in FIG. 2, a primary supply conduit 154 extends from pump 152, along rear side 112 of tub 104 along the vertical direction V to supply wash fluid throughout wash chamber 106. In some examples, a secondary supply conduit (not shown) may supply additional wash fluid to one or more various spray assemblies and manifolds.

As illustrated, primary supply conduit 154 is used to supply wash fluid to mid-level spray arm assembly 140 while a secondary supply conduit 92 supplies wash fluid to upper spray assembly 142. Diverter assembly 156 can allow selection between spray assemblies 134 and 140, 142 being supplied with wash fluid.

Each spray assembly 134, 140, 142 or other spray device includes an arrangement of discharge ports or orifices for directing wash fluid received from pump 152 onto dishes or other articles located in wash chamber 106. The arrangement of the discharge ports, also referred to as jets, apertures, or orifices, provides a rotational force by virtue of wash fluid flowing through the discharge ports. Alternatively, spray assemblies 134, 140, 142 are motor-driven, or may operate using any other suitable drive mechanism. Spray manifolds and assemblies may also be stationary. Movement of the spray arm assemblies 134 and 140 and the spray from fixed manifolds like spray assembly 142 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber (not shown) for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber (not shown). In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which (e.g., 154) are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counterclockwise direction, a third conduit for spraying rack assembly 126 (shown in FIG. 2) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle. Different spray assemblies and alternative configurations for providing fluid to the spray assemblies may be used in other embodiments of the invention.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 is located within a control panel area 162 of door 116. In such an embodiment, input/output ("I/O") signals may be routed between the control system and various operational components of dishwasher appliance 100 along wiring harnesses that may be routed through the bottom of door 116. Typically, the controller 160 includes a user interface panel/controls 164 (FIG. 1) through which a user may select various operational features and modes and monitor progress of the dishwasher appliance 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

Dishwasher appliance 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher appliance 100 may be equipped with such image recognition and processing capabilities as part of controller 160 and/or other components onboard appliance 100.

It should be appreciated that the invention is not limited to any particular style, model, or configuration of dishwasher appliance 100. The exemplary embodiment depicted in FIGS. 1 and 2 is for illustrative purposes only. For example, different locations may be provided for user interface 164. Different configurations, including providing one or more rack assemblies 122, 124, 126 and one or more spray assemblies 134, 140, 142, for dishwasher appliance 100 may be used. Other differences may also be applied while remaining within the scope of the present subject matter.

In one exemplary aspect, the present invention provides improved mounting for a rack assembly of a dishwashing appliance. For the description that follows, an exemplary embodiment will be described with reference to the upper or third rack assembly 126. Using the teachings disclosed herein, one of skill in the art will understand that, in other embodiments, one or more aspects of the invention may be used with other rack assemblies such as middle and lower rack assemblies as well.

Figure 5:
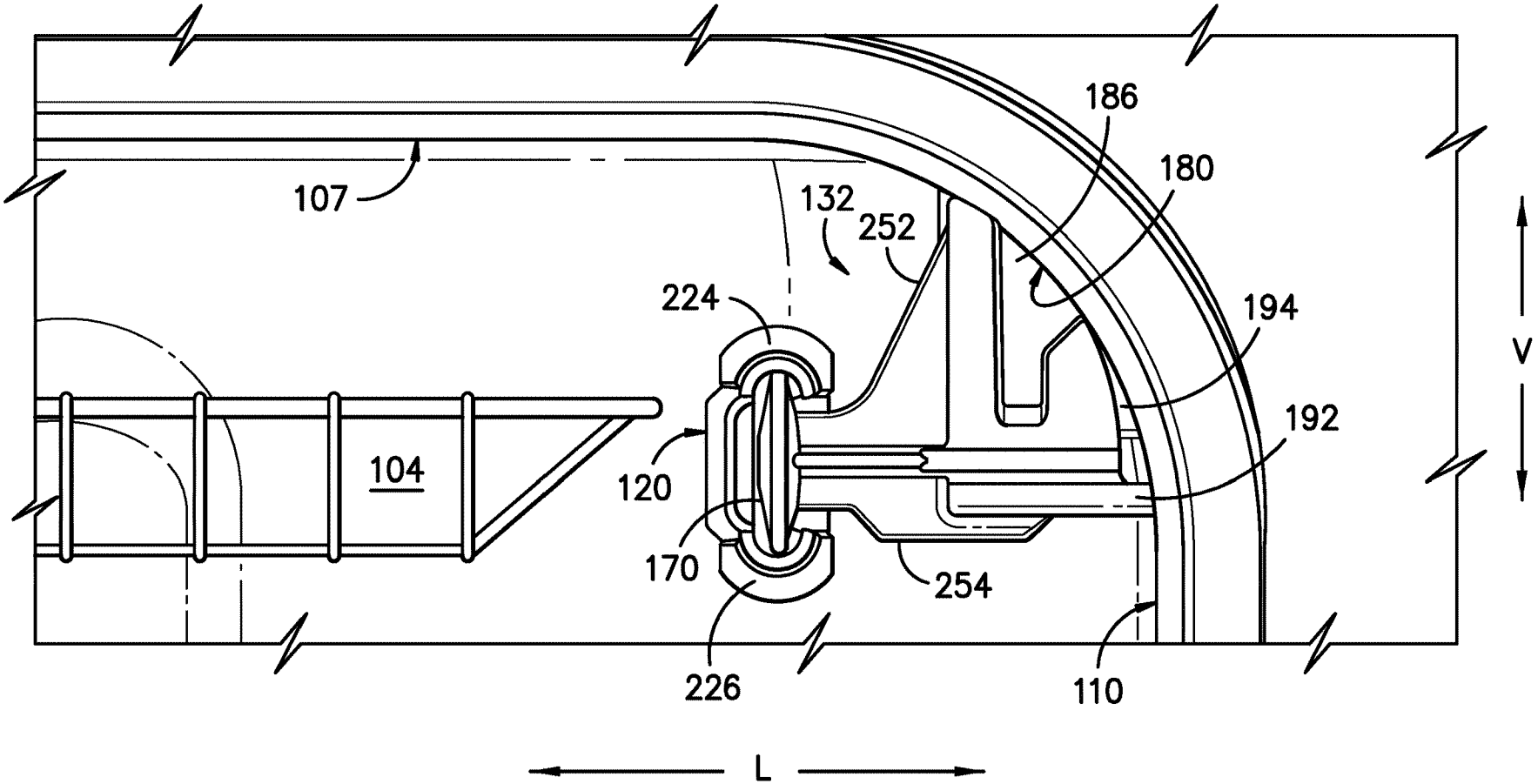
FIG. 5 provides a front view of one lateral side of a rack assembly, including the exemplary tub mount of FIGS. 3 and 4.

Turning to FIGS. 3 through 6, for this exemplary embodiment, a pair of tub mounts 132 are mounted to tub 104 and are spaced apart from each other along lateral direction L. A pair of slide rails 120 are attached, one each, to the opposing sides 144 of rack assembly 126. As shown in FIG. 5, slide rails 120 are each in sliding receipt of a fixed disc 170 provided by a respective tub mount 132 and are configured for slidingly supporting upper rack assembly 126 within appliance 100. It is envisioned that embodiments of the invention include a different number of tub mounts 132 with each mount having a different number of fixed discs 170 from that shown in the figures, including, for example, a dishwasher appliance with multiple tub mounts, each with one fixed disc.

Figure 6:
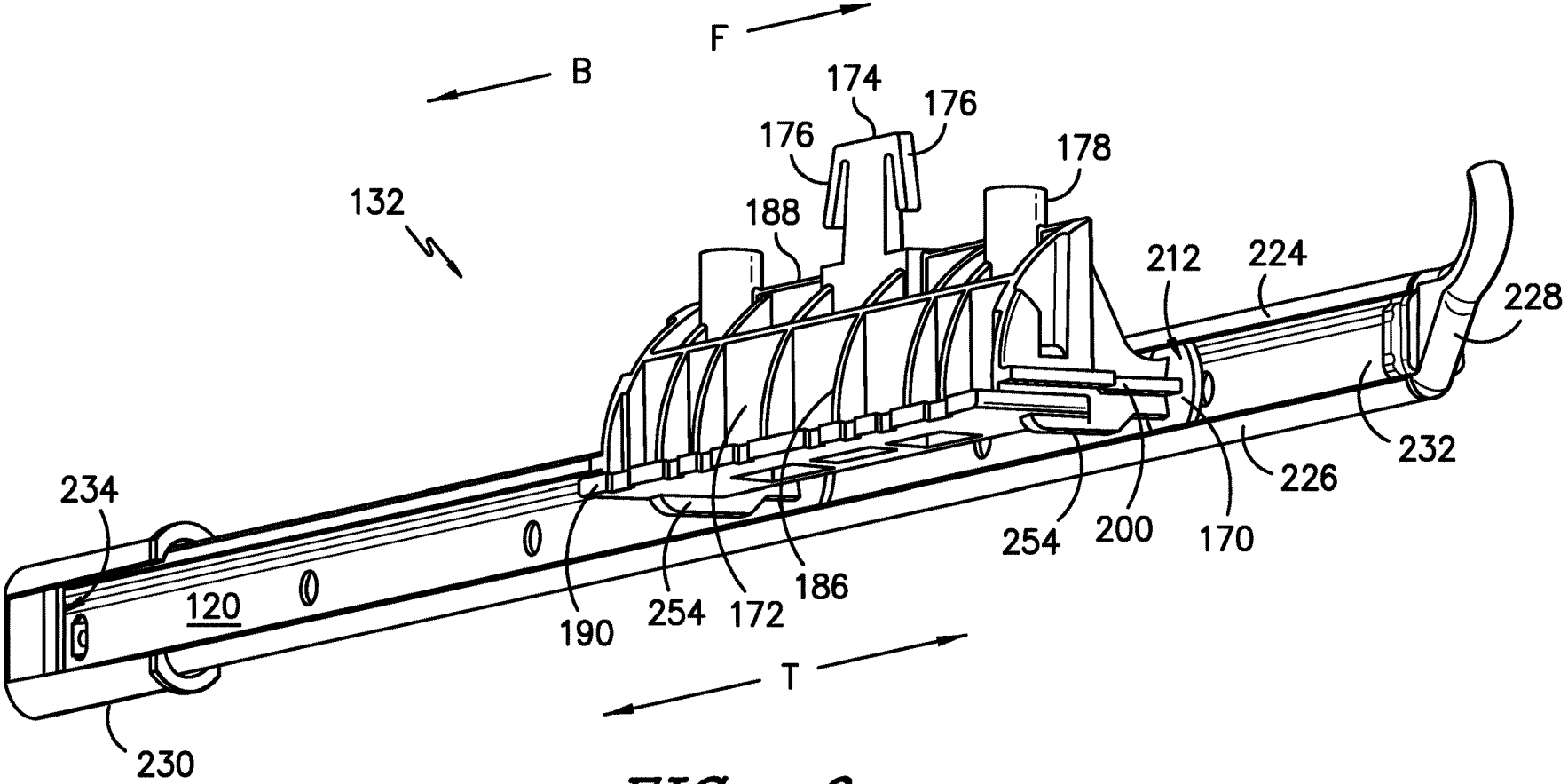
FIG. 6 provides a perspective view of an exemplary embodiment of a slide rail with the exemplary tub mount of FIGS. 3 through 5.
Figure 7:
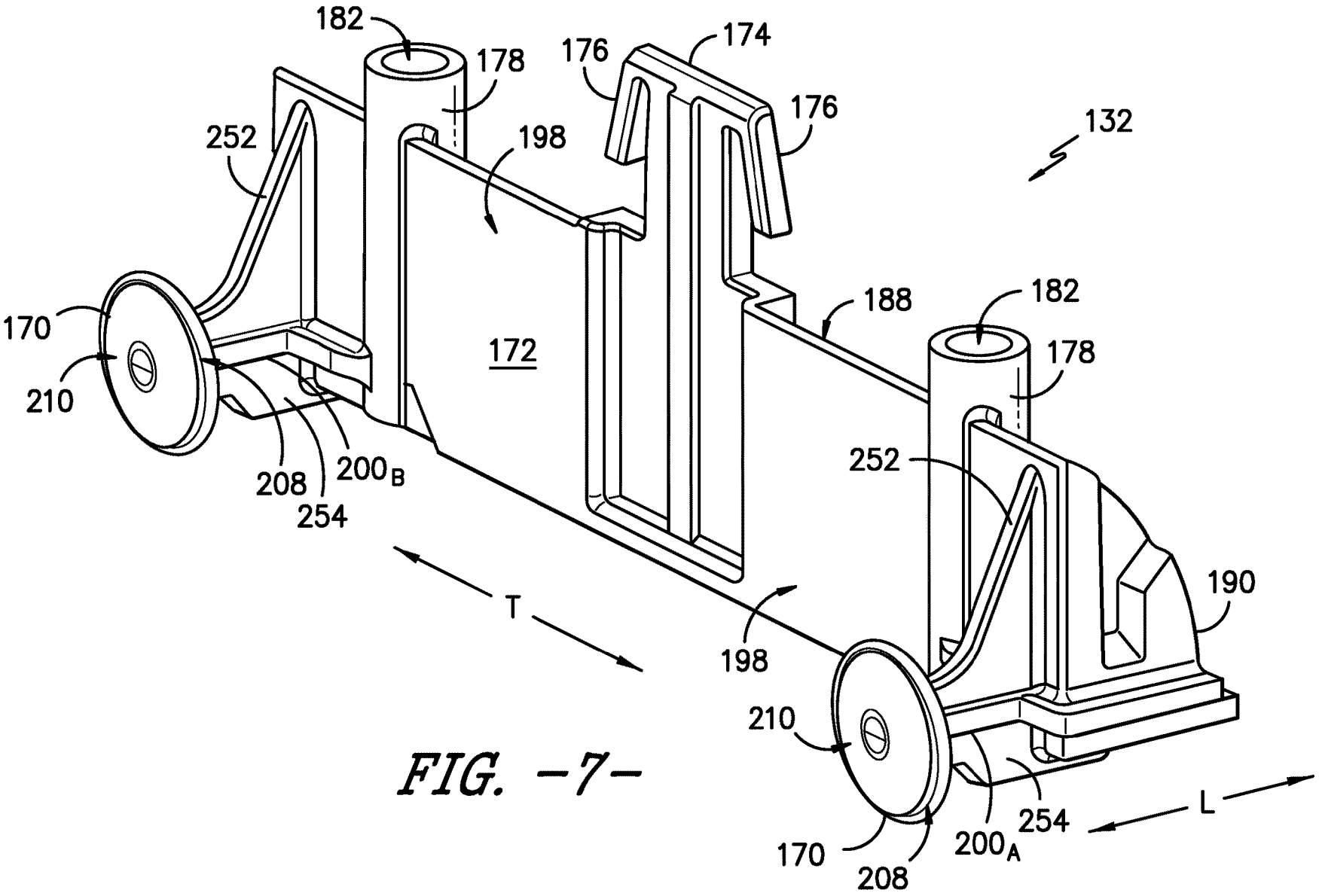
FIG. 7 provides a perspective view of the exemplary embodiment of a tub mount used in FIGS. 3 through 6.

Each slide rail 120 includes an upper track 224 and a lower track 226 extending along transverse direction T with at least two fixed discs 170 captured therebetween for this embodiment. As shown in FIG. 5, upper track 224 and lower track 226 each have an arcuate profile configured for sliding receipt of an outermost contact surface 208 of fixed discs 170. With reference to FIG. 6, slide rail 120 has an end cap 228 attached to a front transverse end 232 of slide rail 120 and a back stop 230 attached to a back transverse end 234 of slide rail 120. End cap 228 and back stop 230 prevent the slide rail 120 from falling off the fixed disc 170, which keeps the rack assembly, for example upper rack assembly 126, properly aligned as it moves in and out of the wash chamber 106.

Continuing with FIGS. 3 through 9, each tub mount 132 include a base 172 attached to tub 104. Each base 172 includes a pair of mounting posts 178 forming apertures 182 that are configured to accept fasteners (not shown) for attaching tub mount 132 to tub 104—such as to top 107. Fasteners may include screws, washers, nails, bolts, or other fasteners as known in the art. For this embodiment, mounting posts 178 are spaced apart along the transverse direction T and face upwardly along vertical direction V for receipt of fasteners extending through top 107.

In some examples, a hook 174 aids installation of the tub mount 132 by holding the tub mount 132 in tub 104. For example, during manufacture, each mount 132 can be attached to the top 107 of the tub 104 using a hook 174 that can be inserted through an opening in top 107. Hook 174 extends vertically from the base 172 and has two opposing flanges 176 extending vertically down. More particularly, flanges 176 extend outwardly from an upper center of the hook 174 in opposing manner along transverse direction T. Flanges 176 are made of a resilient material allowing hook 174 to be inserted through an opening—during which flanges 176 will fold and then return to their original shape to hold tub mount 132 in place until fasteners can be secured in mounting posts 178.

Base 172 of the tub mount 132 can have a shape or profile along transverse direction T that conforms to the inside walls of tub 104 where tub mount 132 is attached. For example, base 172 may have a curved shape that conforms to curved wall 180 where top 107 and side wall 110 meet (FIG. 5). For this embodiment, base 172 of the tub mount 132 has a plurality of fins 186 extending from a top portion 188 of base 172 to a lateral bottom portion 190 of base 172 with each shaped to match curved wall 180.

Figure 8:
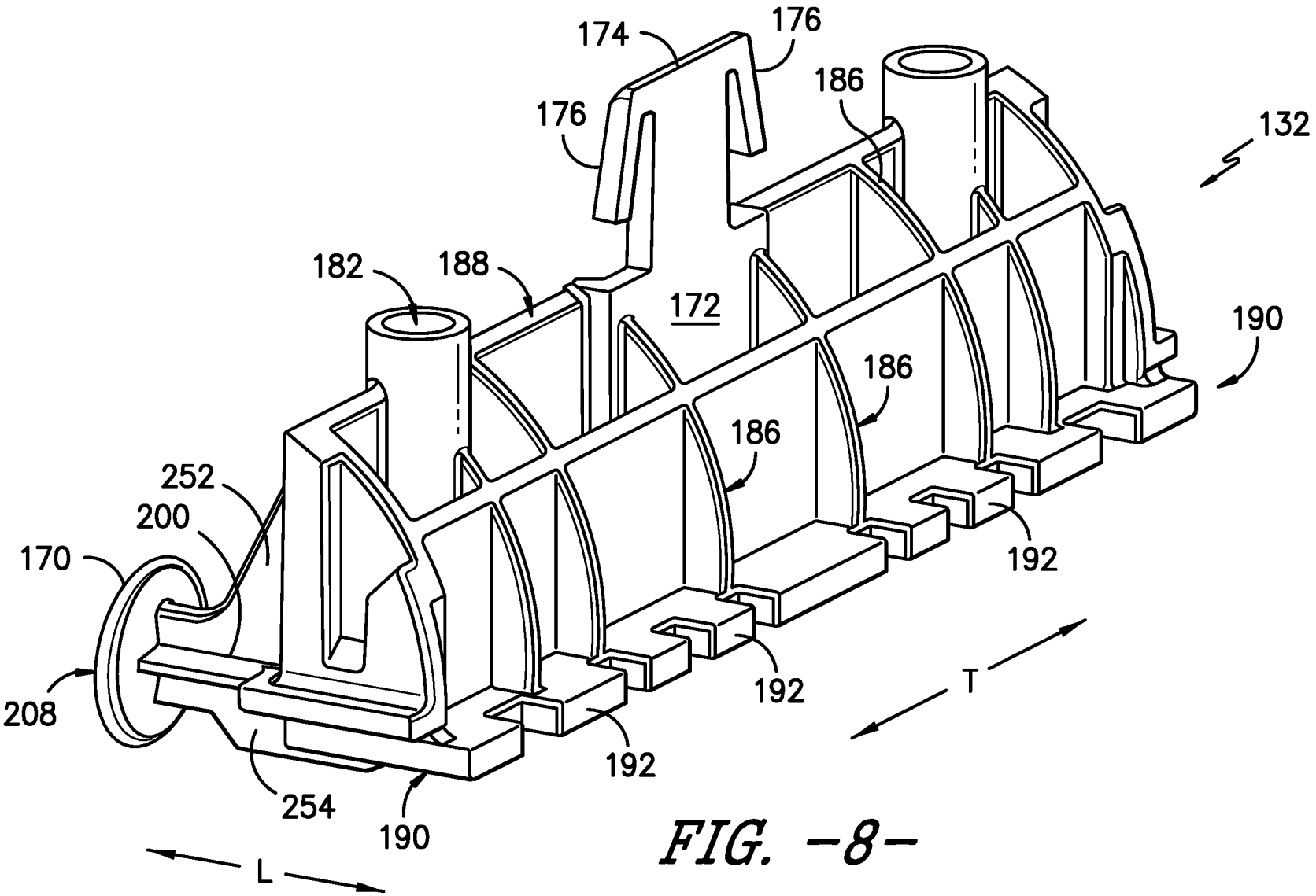
FIG. 8 is an opposing perspective view of the exemplary embodiment of tub mount depicted in FIG. 7.

Lateral bottom portion 190 of tub mount 132 defines a plurality of feet 192 (FIG. 8). Separated by grooves, feet 192 are located adjacent to each other along transverse direction T. Feet 192 align with one or more projections 194 (FIG. 5) on side wall 110 to and aid in the positioning of tub mount 132.

With reference to FIGS. 6 through 12, each tub mount 132 includes a pair of beams $\mathbf{200}_A$ and $\mathbf{200}_B$. Each beam 200 is connected between non-rotatable, fixed disc 170 and base 172. Each beam 200 extends along lateral direction L between fixed disc 170 and base 172—projecting from base 172 in a direction laterally inward towards the center of tub 104. Beam 200 does not contact slide rails 120 in this embodiment. Beam 200 rigidly fixes the position of fixed disc 170 as it slides within slide rails 120 back and forth (arrows B and F in FIG. 6) along transverse direction T when rack assembly 126 is moved in and out of appliance 100. Each beam 200 is attached to base 172 at an inner side 198 that faces laterally into the tub 104.

Each beam $\mathbf{200}_A$ and $\mathbf{200}_B$, is attached to base 172 near lateral bottom portion 190 and at opposing ends along transverse direction T of tub mount 132. Each beam 200 may include one or more ribs that extend between fixed disc 170 and base 172 and provide for strengthening and rigidity of beam 200. For the exemplary embodiment shown, each beam 200 includes upper ribs 252 and lower ribs 254 that connect with, and extend between, fixed disc 170 and base 172. Ribs 252 and 254 lie within the same plane along vertical direction V for this exemplary embodiment of tub mount 132. With reference to vertical direction V, upper rib 252 is positioned on top of each beam 200 while an opposing, lower rib 254 is positioned on the bottom of each beam 200.

Figure 10:
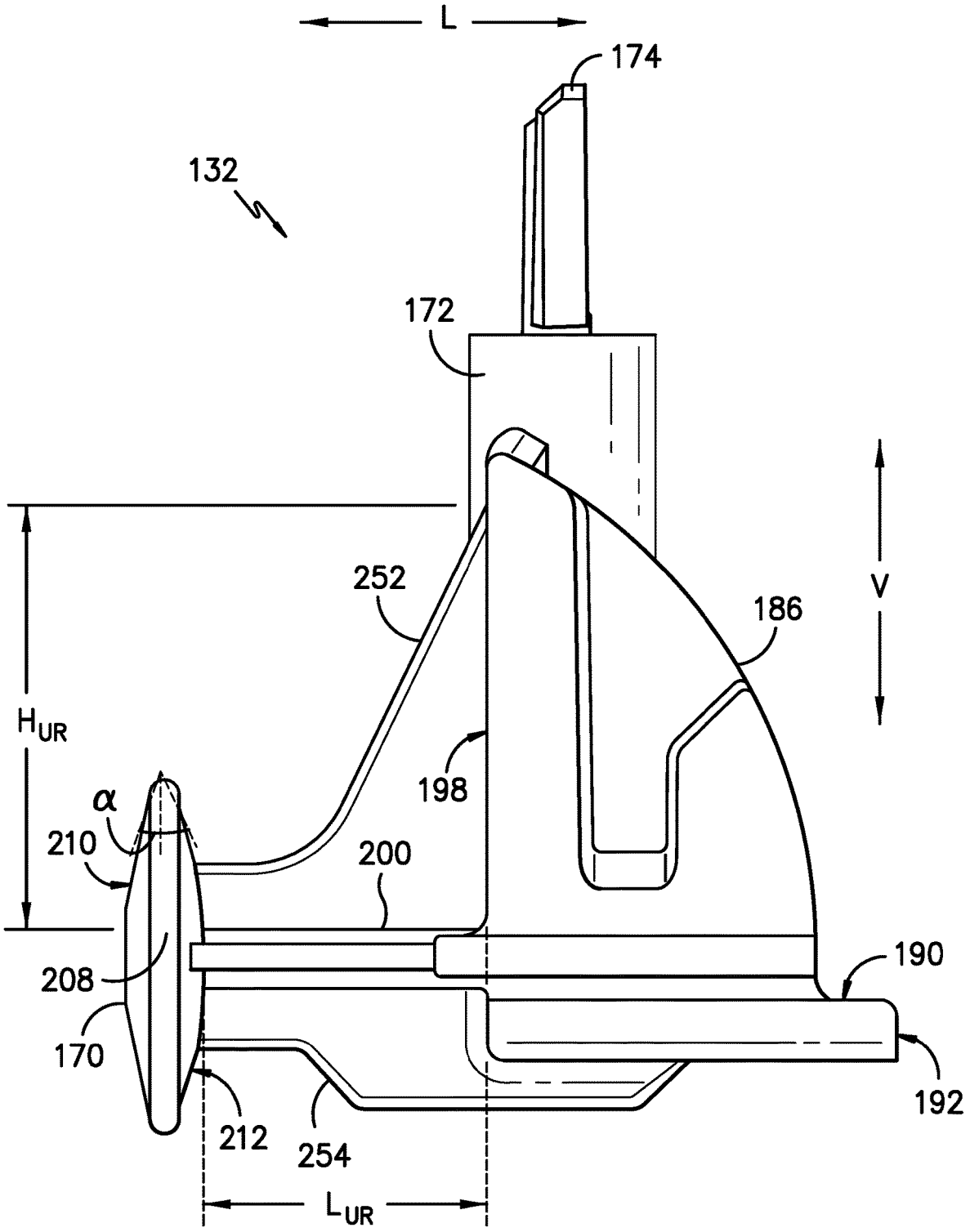
FIG. 10 is an end view of the exemplary embodiment of tub mount depicted in FIGS. 7 through 9.

For this exemplary embodiment, each upper rib 252 extends along lateral direction L from a laterally outer side 212 (FIGS. 10 through 12) of fixed disc 170 to base 172 of the tub mount 132. Upper ribs 252 also increase in height along vertical direction V moving along lateral direction L from fixed disc 170 to base 172 (FIG. 10). By way of example, the maximum height $H_{UR}$ of upper rib 252 at base 172 is more than 4 times the height of upper rib 252 at fixed disc 170. In addition, upper rib 252 has a maximum height $H_{UR}$ along vertical direction V that is greater than its length $L_{UR}$ between base 172 and fixed disc 170 (FIG. 10). For example, in certain embodiments, the ratio of height H to length L (H/L) is in the range of 1 to 2.1.

Figure 11:
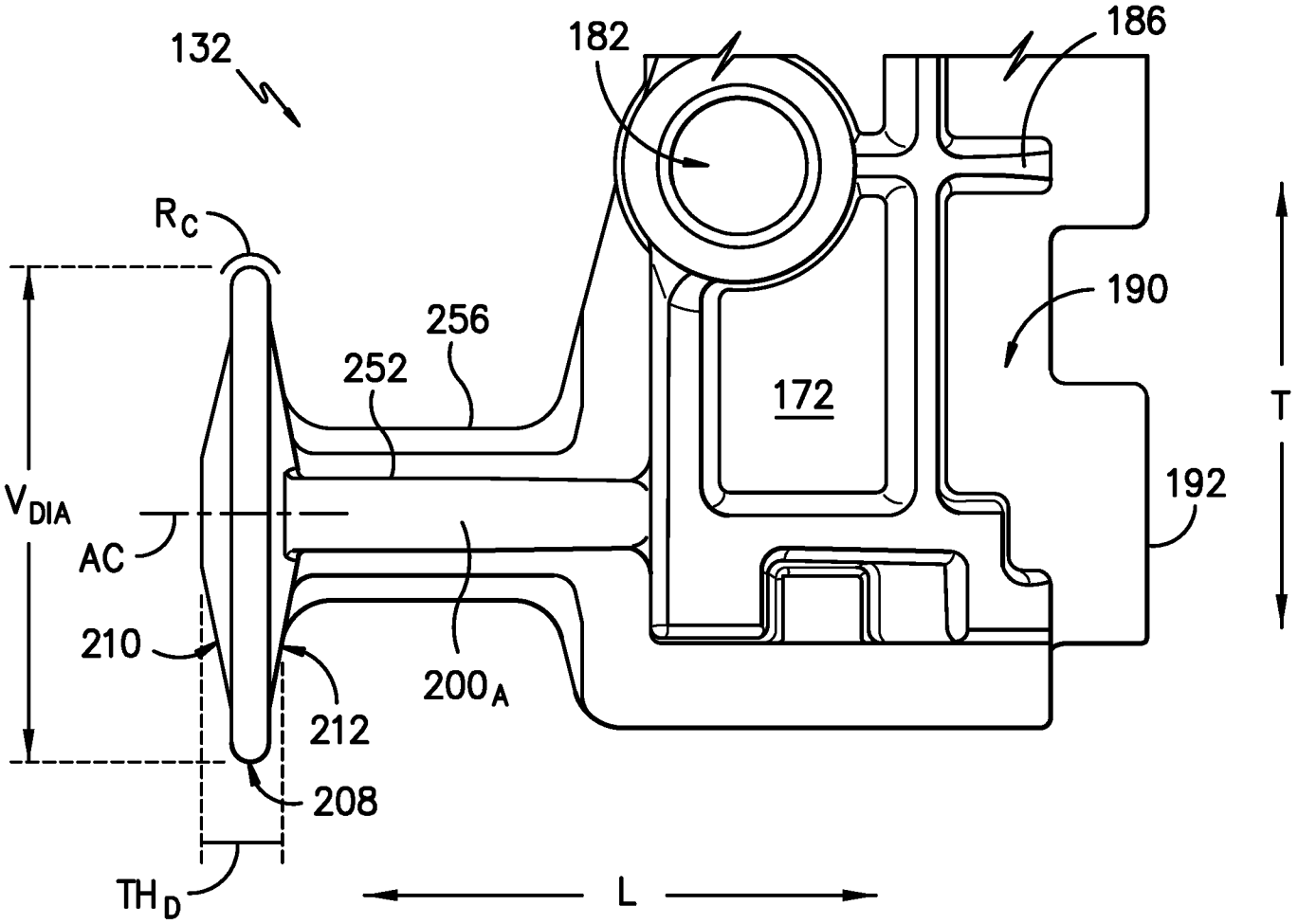
FIG. 11 is a top view of a front portion of the exemplary embodiment of tub mount depicted in FIGS. 7 through 10.

Each fixed disc 170 is non-rotatable relative to beam 200 and, for this exemplary embodiment, is formed integrally with beam 200. Fixed disc 170 has a vertical disc diameter $V_{DIA}$ within a plane that includes both the vertical V and transverse T directions and has a disc thickness $T_{HD}$ along lateral direction L (FIG. 10). Fixed disc 170 forms an outermost contact surface 208 extending circumferentially around the fixed disc 170. Thickness $T_{HD}$ is thicker at an axial center AC on each fixed disc 170 than at outermost contact surface 208. As shown in FIGS. 10 and 11, outermost contact surface 208 has a profile that is arcuate in shape—particularly at the vertical disc diameter $V_{DIA}$—as viewed along transverse direction T.

Figure 9:
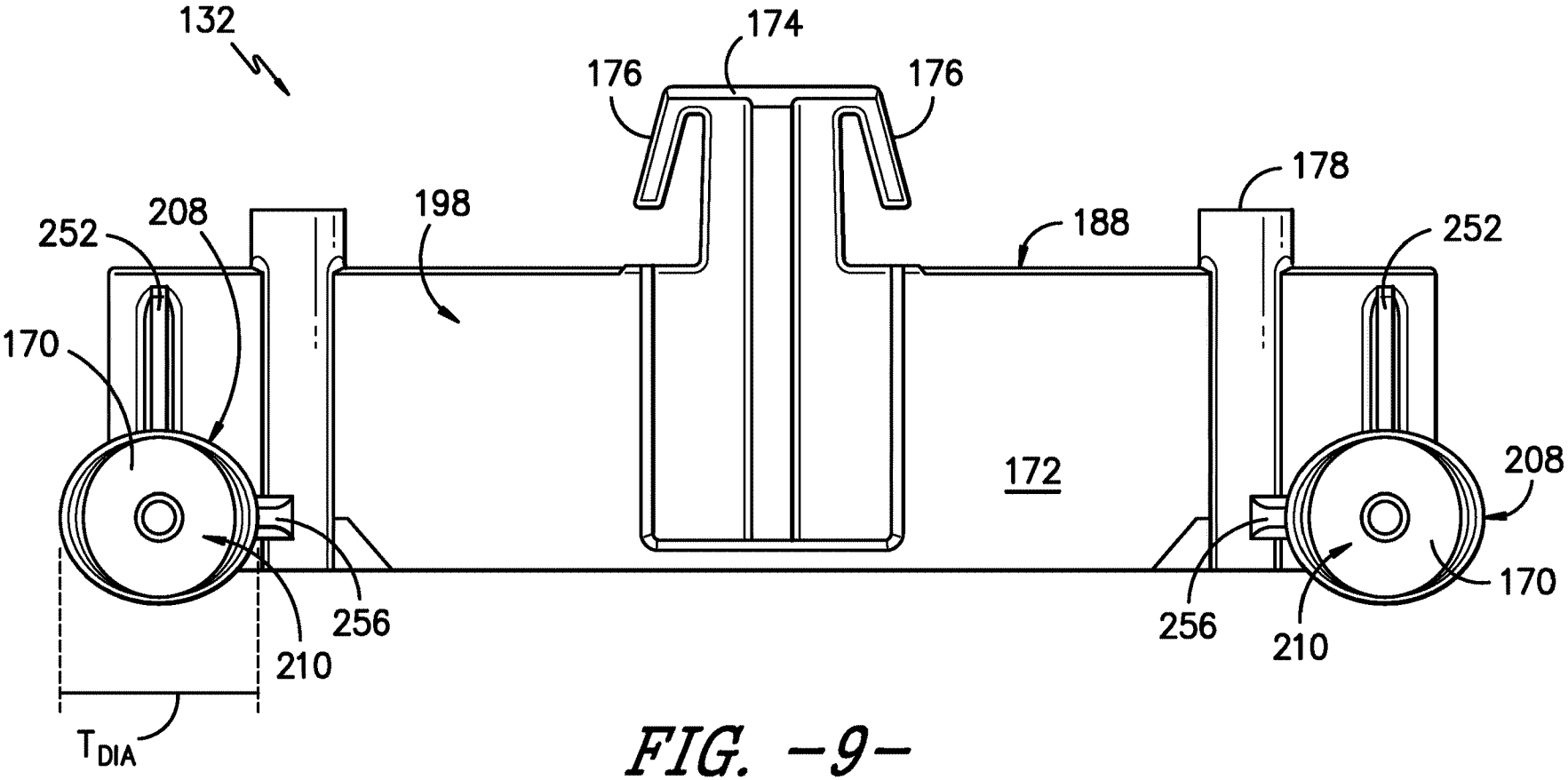
FIG. 9 is a side view of the exemplary embodiment of tub mount depicted in FIGS. 7 and 8.

As illustrated in FIG. 9, for this exemplary embodiment, each fixed disc 170 is elliptical in shape. More particularly, each fixed disc 170 has a transverse disc diameter $T_{DIA}$ within a plane that includes both the vertical V and transverse T directions. For this exemplary embodiment, transverse disc diameter $T_{DIA}$ is greater than vertical disc diameter $V_{DIA}$. In other embodiments, a circular shape for fixed disc 170 may be used.

Figure 12:
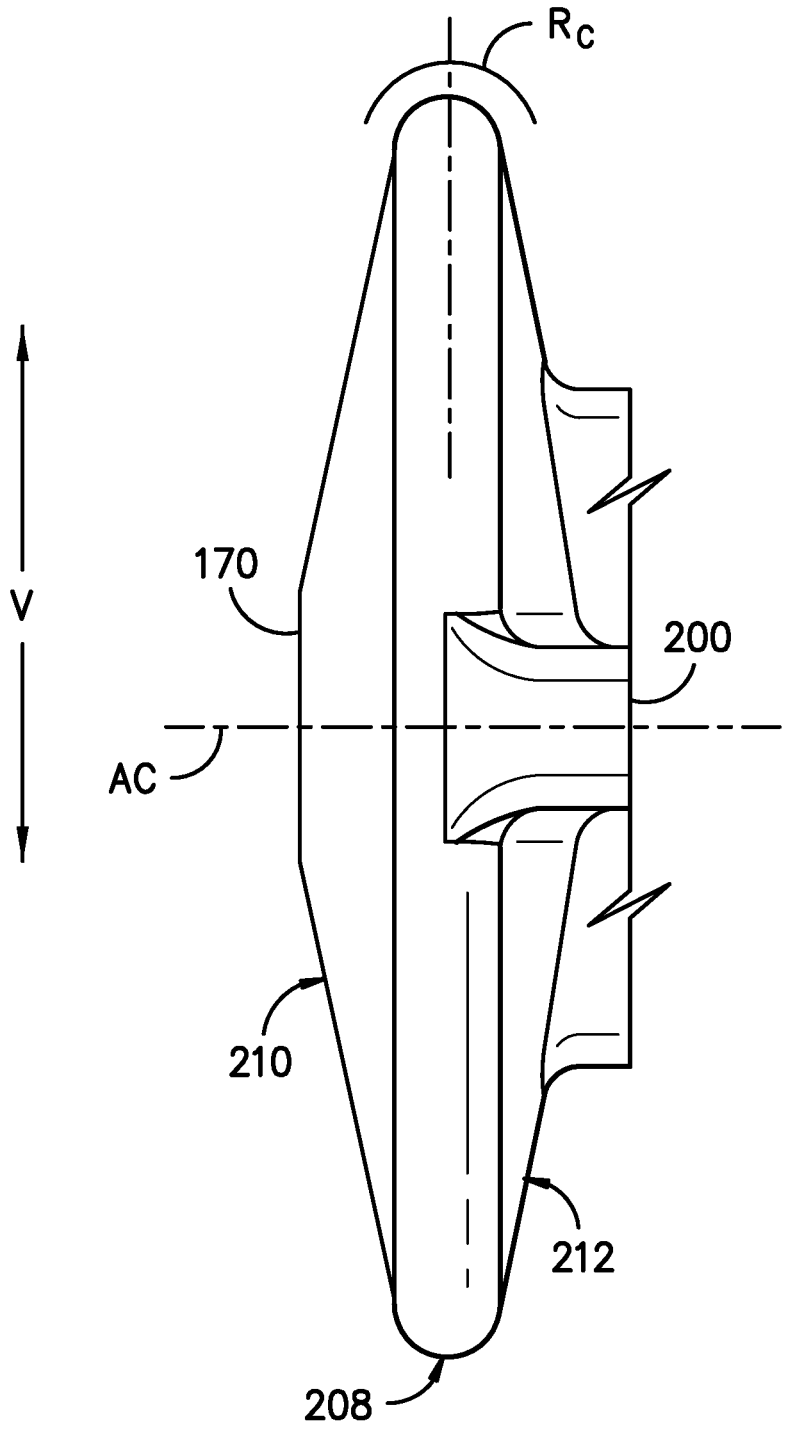
FIG. 12 provides a profile view of an exemplary embodiment of a disc of the exemplary tub mount of FIGS. 3 through 11.

With reference to FIG. 12, each fixed disc 170 has a laterally inner side 210 and a laterally outer side 212. Laterally outer side 212 is on the same side as beam 200. Laterally inner side 210 faces into the wash chamber 106, while laterally outer side 212 faces towards the base 172 of a respective tub mount 132. Each fixed disc 170 defines the axial center AC, which is centered relative to outermost contact surface 208 along vertical direction V and transverse direction T. Along a vertical direction V from axial center AC towards outermost contact surface 208, sides 210 and 212 form an acute angle $\alpha$. In one exemplary embodiment, angle $\alpha$ is in the range of 0° to 30°. In another exemplary embodiment, angle $\alpha$ is in the range of 20° to 30°. In still another exemplary embodiment, angle $\alpha$ is about 24°.

By controlling the value of angle $\alpha$ and the radius of curvature $R_c$ of outermost contact surface 208, each fixed disc 170 can be configured so that contact between fixed disc 170 and the inner surfaces of upper track 224 and lower track 226 (FIG. 5) is reduced or minimized. This limited surface contact between the fixed disc 170 and the slide rails 120 serves to minimize friction and aid in sliding of rack assembly 126 in and out of the wash chamber 106. Furthermore, in certain exemplary embodiments, inner side 210 and the outer side 212 of each fixed disc 170 are also not in contact with slide rail 120, which further minimizes friction and reduces the force required to move rack assembly 126 along transverse direction T in and out of wash chamber 106 of appliance 100. In one exemplary embodiment, the radius of curvature is in the range of about 0.08" to about 0.025".

Figure 14:
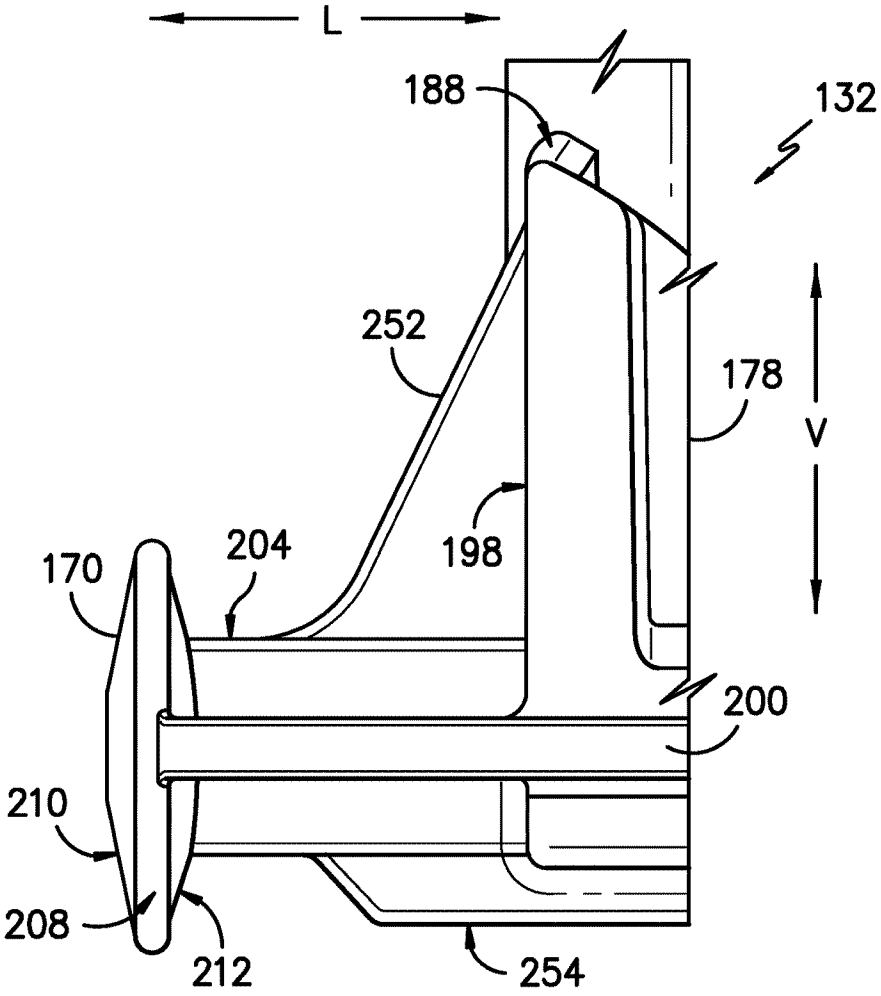
FIG. 13 through 15 provide views of portions of another exemplary embodiment of a tub mount of the present invention.
Figure 13:
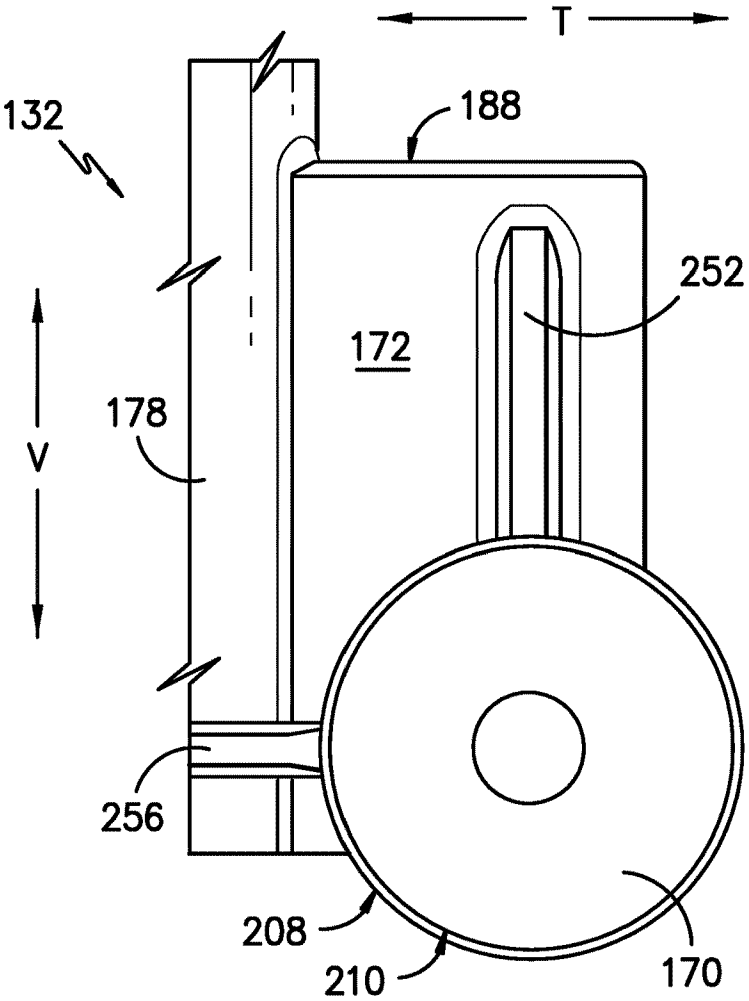
Figure 15:
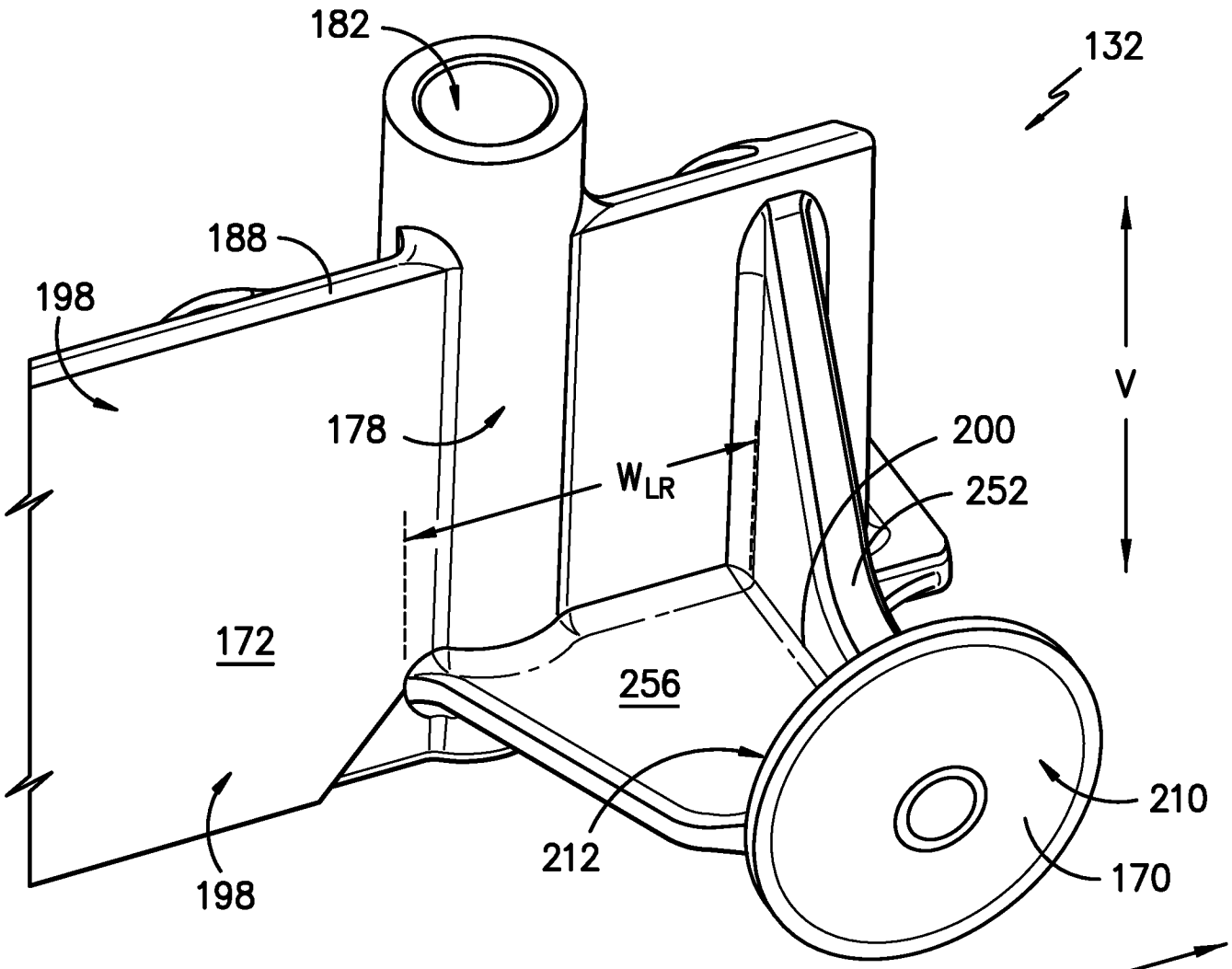

Different shapes and configurations for the ribs associated with beams 200 may be used. FIGS. 13 through 15 illustrate another exemplary embodiment of a tub mount 132 of the invention. For this embodiment, upper rib 252 does not extend completely between base 172 and a respective fixed disc 170 as with the previous embodiment (compare FIG. 14 with FIG. 10). Instead, upper rib 252 extends only partially along lateral direction L so that a gap 204 is present between the laterally inner end 253 and fixed disc 170.

Additionally, for this embodiment, mount 132 includes an inner transverse rib 256 extending along transverse direction T from frontward beam $\mathbf{200}_A$ towards rearward beam $\mathbf{200}_B$ (with front being relative to the door 116 of appliance 100). Inner transverse rib 256 lies within a plane that include lateral direction L and transverse direction T. Additionally, the transverse width $W_{LR}$ of rib 256 decreases along the lateral direction L moving from base 172 towards fixed disc 170. For this exemplary embodiment, transverse width $W_{LR}$ of rib 256 at base 172 extends from beam $\mathbf{200}_A$ past mounting post 178. At fixed disc 170, transverse width $W_{LR}$ of rib 256 is such that rib 256 connected with outermost contact surface 208 of fixed disc 170. As previously mentioned, fixed disc 170 can be circular in shape as illustrated for the exemplary embodiments of FIGS. 13 through 15.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining vertical, lateral, and transverse directions, the dishwasher appliance comprising:

a tub defining a wash chamber for receipt of articles for washing;

a pair of tub mounts spaced apart from each other along the lateral direction, each tub mount comprising a base attached to the tub; and a pair of fixed discs connected with the base, each fixed disc having a disc diameter, each fixed disc being non-rotatable relative to the base and forming an outermost contact surface extending circumferentially around the fixed disc and defining a vertical disc diameter;

at least one rack assembly slidably positioned within the wash chamber and configured for the receipt of articles for washing, the at least one rack assembly having opposing sides separated along the lateral direction;

a pair of slide rails, one each attached to one of the opposing sides of the at least one rack assembly, each slide rail defining an upper track and a lower track extending along the transverse direction and in receipt of the pair of fixed discs, the upper track having an arcuate profile configured for sliding receipt of an outermost contact surface of each disc;

at least one spray assembly positioned in the wash chamber near the at least one rack assembly and configured to direct wash fluids at the at least one rack assembly;

a beam connecting extending between the fixed disc and the base along the lateral direction; and at least one rib affixed to the beam and extending between the fixed disc and the base, the at least one rib configured to reinforce the beam.

2. The dishwasher appliance of claim 1, wherein the vertical disc diameter lies in plane that includes both the vertical and transverse directions, wherein each disc has a disc thickness along the lateral direction, and wherein the vertical disc diameter exceeds the disc thickness.

3. The dishwasher appliance of claim 1, wherein for each fixed disc, the at least one rib further comprises:

an upper rib positioned on a top of the beam; and a lower rib positioned on a bottom of the beam.

4. The dishwasher appliance of claim 3, wherein for each fixed disc the upper rib increases in height along the vertical direction moving laterally from the fixed disc towards the base.

5. The dishwasher appliance of claim 4, wherein for each fixed disc, the upper rib and the lower rib are positioned out of contact with the pair of slide rails.

6. The dishwasher appliance of claim 1, wherein each fixed disc is integrally formed with the tub mount.

7. The dishwasher appliance of claim 1, wherein each disc has a disc thickness along the lateral direction and wherein a ratio of the disc diameter to the disc thickness is in the range of 1 to 2.1.

8. The dishwasher appliance of claim 1, wherein the outermost contact surface of each fixed disc has a radius of curvature in a plane that includes the lateral direction and the vertical direction, and wherein the radius of curvature is in a range of about 0.08" to about 0.025".

9. The dishwasher appliance of claim 1, wherein each fixed disc comprises a pair of lateral sides, and herein each lateral side forms an acute angle with the vertical direction that is in a range of 0° to 30°.

10. The dishwasher appliance of claim 1, wherein the at least one fixed disc further has an axial center, a radial center thickness, an inner side facing laterally into the wash chamber, and an outer side facing laterally towards the base it is attached to, wherein a thickness between the inner side and the outer side is thicker at the axial center than a thickness between the inner side and the outer side is at the outermost contact surface.

11. A dishwasher appliance defining vertical, lateral, and transverse directions, the dishwasher appliance comprising:

a tub defining a wash chamber for receipt of articles for washing;

at least two tub mounts spaced apart from each other along the lateral direction, each tub mount comprising a base attached to the tub; and at least one fixed disc connected with the base, the fixed disc having a disc diameter, each fixed disc being non-rotatable relative to the base and forming an outermost contact surface extending circumferentially around the fixed disc and defining a vertical disc diameter;

at least one rack assembly slidably positioned within the wash chamber and configured for the receipt of articles for washing, the at least one rack assembly having opposing sides separated along the lateral direction;

a pair of slide rails, one each attached to one of the opposing sides of the at least one rack assembly, each slide rail defining an upper track and a lower track extending along the transverse direction and in receipt of at least one fixed disc, the upper track having an arcuate profile configured for sliding receipt of an outermost contact surface of the fixed disc; and at least one spray assembly positioned in the wash chamber near the at least one rack assembly and configured to direct wash fluids at the at least one rack assembly, wherein for each fixed disc, the tub mount further comprises a beam extending between the fixed disc and the base along the lateral direction and at least one rib affixed to the beam, the at least one rib configured to reinforce the beam.

12. The dishwasher appliance of claim 11, wherein the vertical disc diameter lies in plane that includes both the vertical and transverse directions, wherein each disc has a disc thickness along the lateral direction, and wherein the vertical disc diameter exceeds the disc thickness.

13. The dishwasher appliance of claim 11, wherein each fixed disc is integrally formed with one of the tub mounts.

14. The dishwasher appliance of claim 11, wherein for each fixed disc, the at least one rib extends between the fixed disc and the base.

15. The dishwasher appliance of claim 11, wherein for each fixed disc, the at least one rib further comprises:

an upper rib positioned on top of the beam; and a lower rib positioned on a bottom of the beam.

16. The dishwasher appliance of claim 15, wherein for each fixed disc, the upper rib and the lower rib are positioned out of contact with the pair of slide rails.

17. The dishwasher appliance of claim 11, wherein the at least one fixed disc further has an axial center, a radial center thickness, an inner side facing laterally into the wash chamber, and an outer side facing laterally towards the base it is attached to, wherein a thickness between the inner side and the outer side is thicker at the axial center than a thickness between the inner side and the outer side is at the outermost contact surface.

* * * * *